United States Patent [19]

Bower et al.

[11] 3,958,798

[45] May 25, 1976

[54] DELEAVER FOR CONTINUOUS BUSINESS FORMS ASSEMBLY

[75] Inventors: Kenneth W. Bower, Des Plaines; Burl R. Jones, Sr., Arlington Heights, both of Ill.

[73] Assignee: Uarco Incorporated, Barrington, Ill.

[22] Filed: Dec. 20, 1973

[21] Appl. No.: 426,454

[52] U.S. Cl. ..... 270/52.5

[51] Int. Cl.[2] ..... B65H 41/00

[58] Field of Search ..... 270/52.5, 52; 49/449

[56] References Cited

UNITED STATES PATENTS

| | | | |
|---|---|---|---|
| 2,135,364 | 11/1938 | Templeton | 270/52.5 |
| 2,719,614 | 10/1955 | Sylvan | 49/449 |
| 3,079,142 | 2/1963 | Pine et al. | 270/52.5 |
| 3,386,729 | 6/1968 | Pine | 270/52.5 |

*Primary Examiner*—Edgar S. Burr
*Assistant Examiner*—A. Heinz
*Attorney, Agent, or Firm*—Hofgren, Wegner, Allen, Stellman & McCord

[57] ABSTRACT

An improved deleaver for a continuous business forms assembly for separating the stationery plies and interleaved carbon plies from each other. The invention features a unique carbon turning bar assembly whereby the same is permanently affixed to the machine and yet may be moved between operative and inoperative positions, the latter being used when continuous business forms assemblies not having interleaved carbon are being processed. Also featured is a door in the wall of the first chute which may be selectively opened or closed. When extremely large forms are being processed such that they cannot rest generally parallel to the bottom of the first chute, the door may be opened to allow efficient processing.

4 Claims, 5 Drawing Figures

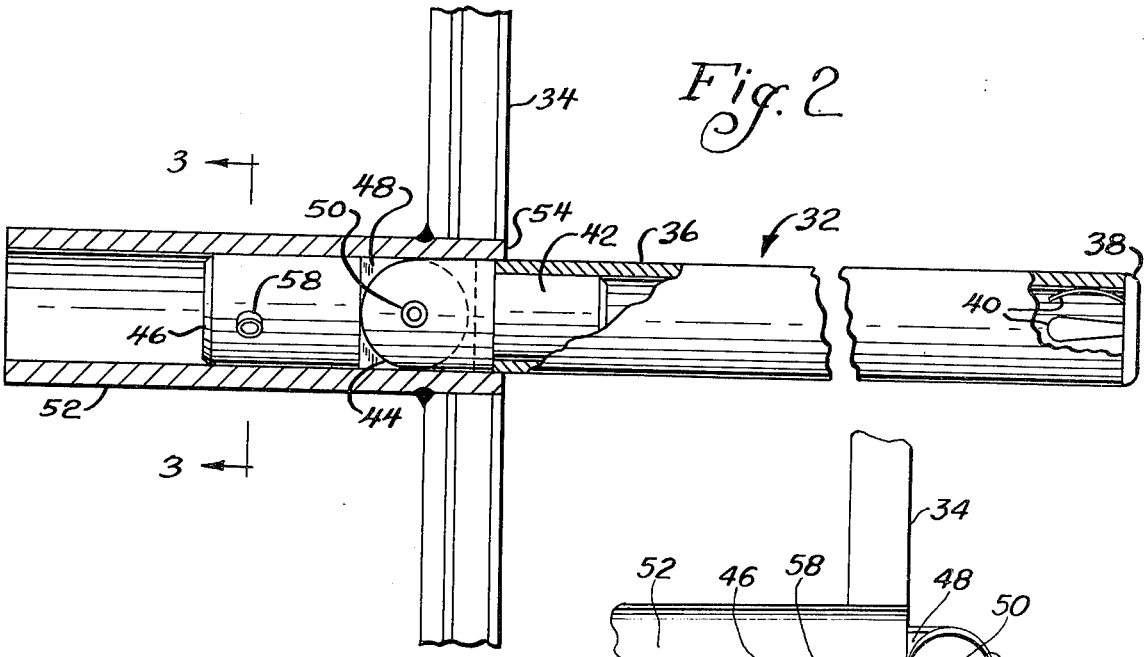
Fig. 2
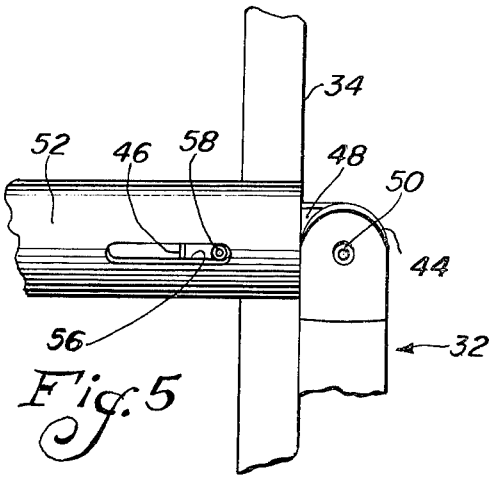
Fig. 5
Fig. 3
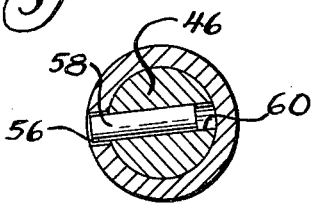
Fig. 4
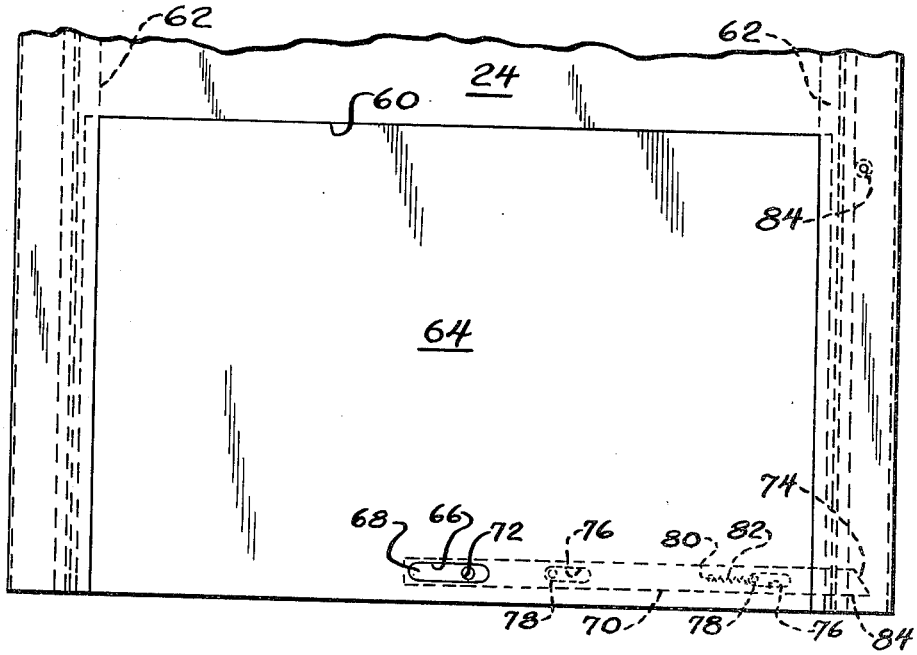

DELEAVER FOR CONTINUOUS BUSINESS FORMS ASSEMBLY

BACKGROUND OF THE INVENTION

This invention relates to deleavers and, more specifically, to improvements in deleavers. Representative prior art is the commonly assigned United States Absler et al Pat. No. 3,514,094.

Mechanized handling of business forms is becoming increasingly popular due to the continual rise of the cost of labor. This is particularly true as regards processing of so-called continuous business forms wherein superimposed plies of stationery in extremely long strips make up a plurality of individual business forms which may be separated from each other by a burster. Frequently, but not always, the various stationery plies will be separated by interleaved carbon plies whereby inscriptions may be transferred throughout the assembly. When assemblies having interleaved carbon are employed, it is necessary to separate the carbon from the stationery plies. This is customarily accomplished when the stationery plies themselves are being separated in a deleaver.

Thus, deleavers customarily include a plurality of chutes each for receiving one or more stationery plies. Associated with each chute is a carbon take-up reel upon which the carbon adjacent the ply moving into the chute may be wound to be subsequently discarded. For smooth operation, such apparatus typically include a carbon turning bar about which the carbon ply may be trained to be directed to the carbon take-up reel. However, when the continuous business forms assembly is not of the type having interleaved carbon plies, the presence of the carbon turning bar may interfere with the refolding operation. Thus, it has heretofore been conventional to make the turning bar removable from the apparatus. Frequently, due to human error, once the turning bar has been removed and physically separated from the deleaver, it becomes misplaced and, thus, is not available for use the next time a continuous business forms assembly having interleaved carbon plies is to be processed.

As is well-known, the refolding operation includes the folding of one or more plies on the bottom of a chute into a zig-zag stack. The width of the stack will be some multiple of the length of an individual business form within the continuous business forms assembly. Because the size of individual form lengths in a continuous business forms assembly varies drastically, in some instances, where extremely large forms are employed, the bottom of the chute onto which the refolded plies come to rest, is not sufficiently large for efficient refolding. While some prior art deleavers have minimized this problem through the provision of an opening in the guide wall of the first chute following the feeding means, this, in itself, poses a problem in that the lack of a guide wall near the bottom of the chute may allow the ply to be refolded to wander and not refold properly.

SUMMARY OF THE INVENTION

It is the principal object of the invention to provide a new and improved deleaver. More specifically, one object of the invention is the provision of a unique carbon turning bar structure wherein the same is effectively permanently attached to the deleaver so that it cannot become separated therefrom and misplaced and yet which may be moved between operative and inoperative positions so as to be placed in the latter when the deleaver is processing forms which do not include interleaved carbon.

Another object of the invention is to provide a new and improved deleaver wherein the first chute is constructed so as to allow the handling of extremely large forms and yet not interfere with the efficient refolding of more conventionally sized forms.

The exemplary embodiment of the invention achieves the first of the above mentioned objects through a structure wherein the carbon turning bar has an end effectively permanently connected to the deleaver so that the same cannot be removed therefrom except for servicing or the like. The connection is a movable one whereby the turning bar can be moved between an operative position extending into the chute to have carbon trained thereabout to a carbon take-up reel or to an inoperative position effectively out of the chute, i.e., against a chute wall.

In the preferred embodiment, the movable connection is both slidable and pivotal. One preferred structure includes the use of a sleeve opening outwardly into the chute. A stub shaft is received within the sleeve for limited slidable movement and, in turn, is pivotally connected to the end of a carbon turning bar. By moving the stub shaft outwardly toward the chute within the sleeve, the pivot may be exposed to allow the carbon turning bar to be pivoted downwardly into substantial abutment with the side wall of the chute. On the other hand, by aligning the turning bar axially with the stub shaft, the stub shaft may be moved inwardly within the sleeve so that an end of the carbon turning bar is also received in the sleeve to maintain the carbon turning bar in an operative position.

The second of the foregoing principal objects is achieved by providing an enlarged, upwardly extending opening in the lower end of the wall of a housing defining the guide wall for the first chute in a deleaver. A door is mounted for movement between positions opening and closing the opening in the guide wall. Thus, when more conventionally sized forms are to be processed, the door may be closed so as to maximize refolding efficiency. On the other hand, when extremely large forms are being processed, the door may be opened so that a portion of the zig-zag stack formed by refolding of the ply may extend through the opening into the housing.

Other objects and advantages will become apparent from the following specification taken in conjunction with the accompanying drawings.

DESCRIPTION OF THE DRAWINGS

FIG. 2 is a side elevation of a carbon turning bar made according to the invention with parts shown in section for clarity;

FIG. 3 is a vertical section taken approximately along the line 3-3 of FIG. 2;

FIG. 4 is a plan view of a housing wall having an opening therein and a door movable with respect to such opening; and FIG. 5 is a fragmentary side elevation of a carbon turning bar made according to the invention in a position of non-use.

DESCRIPTION OF THE PREFERRED EMBODIMENT

Figure 1:
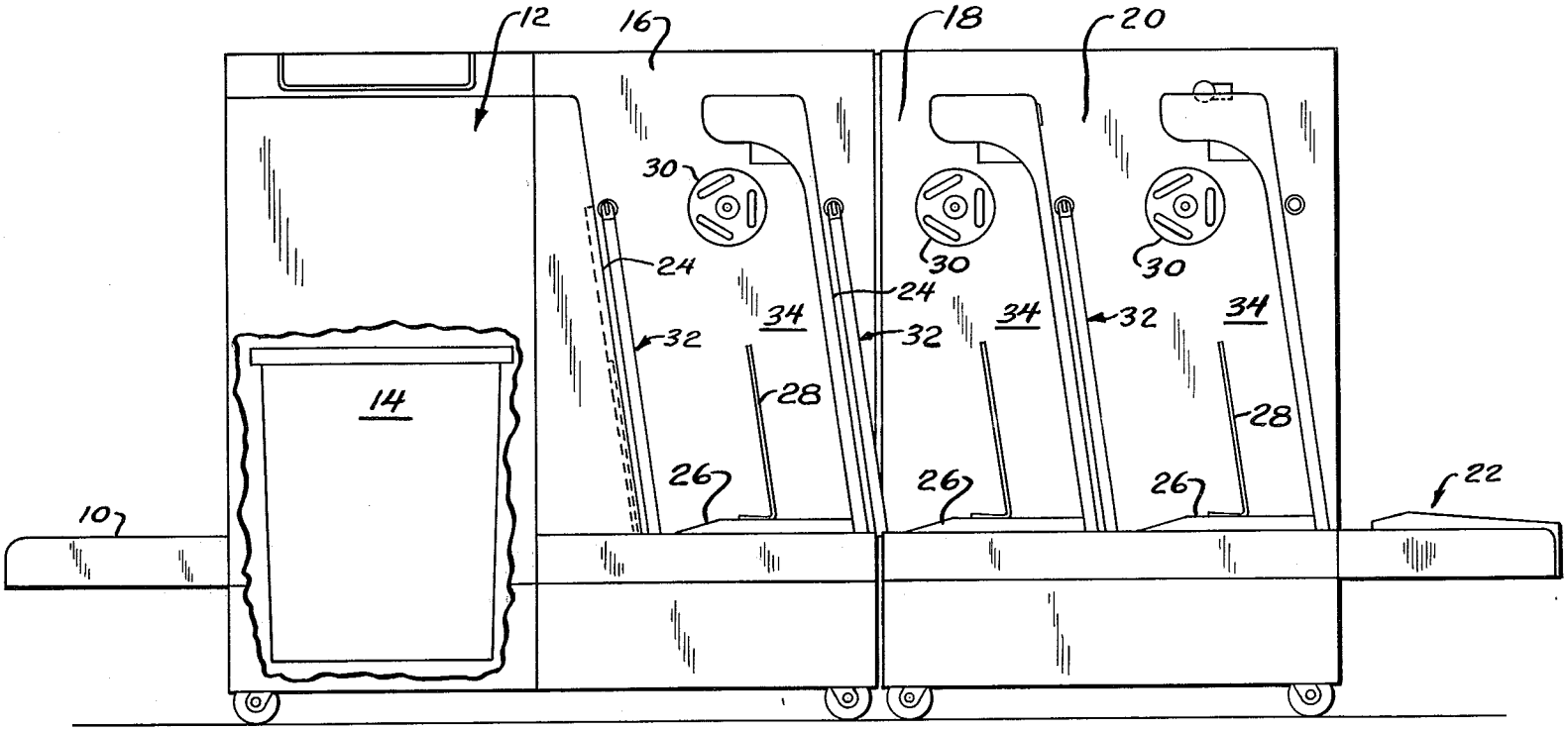
FIG. 1 is a side elevation of a deleaver made according to the invention.

An exemplary embodiment of a deleaver made according to the invention is illustrated in FIG. 1 and is seen to include a shelf 10 on which a zig-zag folded stack of a continuous business forms assembly may be placed to be fed into a deleaver. Adjacent the shelf 10 is a housing, generally designated 12, which may include various drive components for driving the continuous business forms assembly through the deleaver as well as trimming apparatus for trimming the edges of the continuous business forms assembly if that is desired. To this end, the housing 12 may be provided with a door (not shown) through which a bin 14 may be introduced to receive material cut from the assembly by the trimmers.

As the assembly is fed, the various plies thereof are introduced into chutes 16, 18 and 20, as well as to a refolding shelf 22 at the outfeed end of the deleaver. Of course, a greater or lesser number of the chutes 16, 18 and 20 may be employed as desired.

Each of the chutes 16, 18 and 20 includes a paper guide wall 24 which is operative to guide the ply of the stationery being separated into each chute to the bottom 26 of the corresponding chute. Depending upon the width of the zig-zag stack to be formed upon refolding, a guide plate 28 may be adjustably located in the bottom of each chute.

Each of the chutes 16, 18 and 20 further includes a carbon take-up reel 30 near the upper end thereof. The carbon take-up reels 30 are all powered and are operative to wind carbon about the same during a deleaving operation wherein a business forms assembly having interleaved carbon is being deleaved.

Each chute is further provided with a carbon turning bar, generally designated 32, about which the carbon ply adjacent the stationery ply being received in the respective chute may be trained to be fed to the corresponding carbon take-up reel 30. As illustrated in FIG. 1, the carbon turning bars 32 are all shown in inoperative position wherein they are effectively removed from their associated chute 16, 18 and 20. That is, they are shown in positions in substantial abutment with a side wall 34 of the associated chute.

Turning now to FIGS. 2 and 3, each carbon turning bar 32 and its connection to the deleaver will be described in greater detail. Specifically, each carbon turning bar 32 is defined by a tube 36 having one end sealed by a plug 38 formed of plastic or the like and having inwardly directed spring retaining fingers 40. The other end of each tube 36 is secured to a short shaft 42 which has a bifurcated end 44. A stub shaft 46 includes a tongue 48 which is received in the bifurcated end 44 and impaled therein by means of a pivot pin 50. As a result, the tube 36 is pivotally connected to the stub shaft 46.

The stub shaft 46 is slidably received in a sleeve 52 which is secured to the side wall 34 of the associated chute and opens as at 54 into the associated chute. As seen in FIG. 3, the sleeve 52 includes an elongated slot 56 and a pin 58 is received therein to be firmly and securely received in a bore 60 in the stub shaft 46. The slot 56 has both of its ends closed so as to limit the slidable movement of the stub shaft 46 within the sleeve 52. Specifically, the amount of movement permitted is such that the stub shaft 46, and thus the tube 36, may be moved sufficiently to the right, as viewed in FIG. 2, as to allow the pivot pin 50 to emerge from the side wall 34 a sufficient distance that the tube 36 may depend straight downwardly to be in substantial abutment with the side wall 34 as illustrated in FIG. 5. In such a position, the carbon turning bar 32 is in an inoperative position and therefore out of the way when the carbonless business forms assemblies are being deleaved. On the other hand, the slot 56 is sufficiently long so as to permit the stub shaft 46 to be moved to the left from the position shown in FIG. 2 sufficiently that a fair portion of the tube 36 is received within the sleeve 52 so as to maintain the turning bar 32 extending substantially horizontally outwardly into the corresponding chute to be in an operative position whereat carbon may be trained about the same to the associated take-up reel 30.

As a result of the foregoing construction, it will be appreciated that the carbon turning bar 32 is effectively permanently affixed to the deleaver. That is, the same is mounted such that it cannot be removed, save for servicing or the like. As a result, the bar may be shifted easily to its inoperative position when not required and yet, because it is affixed to the machine, cannot become misplaced, resulting in its ready availability the next time the processing of business forms having interleaved carbons takes place.

FIG. 4 shows a preferred construction of the guide wall 24 for the first chute 16. Specifically, near the lower end of the wall 24 there is an enlarged opening 60 which extends to the bottom 26 of the chute 16. Inwardly of the housing of which the wall 24 is a part, are parallel rails 62 which slidably mount a door 64 for movement between the position shown in FIG. 4 to an uppermost position whereat the opening 60 is fully open.

Near the lowermost end of the door 64 there is an elongated slot 66 through which access may be had to an end 68 of an elongated latch 70. The end 68 includes an opening 72 therein by which the latch 70 may be moved to the left as viewed in FIG. 4.

An opposite end of the latch 70 includes an upwardly facing cam surface 74 while intermediate the ends of the latch 70, there are provided a pair of elongated slots 76. Pins 78 are mounted on the back side of the door 64 and extend through the slots 76 so as to mount the latch 70 for reciprocal movement as mentioned previously. Finally, the rear side of the latch 70 mounts a pin 80 and a spring 82 extends between 80 and the rightmost one of the pins 78 and is secured to the two so as to bias the latch 70 toward the right as viewed in FIG. 4.

To the side of the opening 60 and near the upper end thereof is an inwardly projecting pin 84. When the door 64 is moved upwardly on the parallel rails 62, the pin will engage the cam surface 74 thereby camming the latch 70 to the left against the bias of the spring 82 to permit the door to be moved to a fully upward position. At this time, the spring 82 will return the latch 70 to the right, whereupon the underside 84 of the latch 70 will engage the upper surface of the pin 84 to hold the door in its open position. When the door 64 is to be closed, it is merely necessary to manually move the latch 70 to the left through use of the aperture 72.

The foregoing structure allows the interior of the housing having the guide wall 24 for the first chute 16 for refolding where extremely large forms are being employed. That is, where the width of the stack is being refolded in the chute 16, which will be some multiple of an individual form length, is greater than the width of the bottom 26, the door 64 may be opened. On the other hand, where more conventionally sized business forms are being processed, the door 64 may be closed to provide a continuous form guiding action all the way to the bottom 26 of the chute 16.

We claim:

1. A deleaver for separating superimposed plies of stationery and interleaved carbon plies of a continuous business forms assembly including at least one upwardly open chute for receiving at least one stationery ply of the continuous business forms assembly, a powered carbon take-up reel associated with the chute for removing a carbon ply adjacent said one stationery ply from said one stationery ply, a carbon turning bar in said chute about which said carbon ply may be trained and directed to said carbon take-up reel, and means substantially permanently affixing one end of said carbon turning bar to said deleaver so as to prevent removal of said carbon turning bar from said deleaver except for servicing or the like, including means mounting said one end for selective movement of said carbon turning bar on said deleaver between operative and inoperative positions, said mounting means including first means for allowing said carbon turning bar to slidably reciprocate longitudinally along its axis, and second means to allow the carbon turning bar to pivot between said operative position and said inoperative position, said first means further selectively rendering said second means inoperative when the carbon turning bar is pivoted to the operative position.

2. A deleaver for separating superimposed plies of stationery and interleaved carbon plies of a continuous business forms assembly including at least one generally upwardly opening chute having a side wall for receiving at least one stationery ply of the continuous business forms assembly, a powered carbon take-up reel associated with the chute for removing a carbon ply adjacent said one stationery ply from said one stationery ply, a carbon turning bar in said chute about which said carbon ply may be trained and directed to said carbon take-up reel; and means mounting one end of said carbon turning bar on said side wall for movement between a first, operative position wherein said carbon turning bar extends into said chute and a second, inoperative position adjacent said side wall and within said chute, said carbon turning bar being maintained in said second position by gravity until moved to said first position, said mounting means including means substantially permanently affixing said one end to said deleaver so as to prevent removal of said carbon turning bar except for servicing or the like, first means for allowing said carbon turning bar to slidably reciprocate longitudinally along its axis and second means to allow the carbon turning bar to pivot between said first, operative position and said second, inoperative position, said first means further selectively rendering said second means inoperative when the carbon turning bar is pivoted to said first, operative position.

3. A deleaver for separating superimposed plies of stationery and interleaved carbon plies of a continuous business forms assembly including at least one chute for receiving at least one stationery ply of the continuous business forms assembly, a powered carbon take-up reel associated with the chute for removing a carbon ply adjacent said one stationery ply from said one stationary ply, a carbon turning bar in said chute about which said carbon ply may be trained and directed to said carbon take-up reel, and means substantially permanently affixing one end of said carbon turning bar to said deleaver so as to prevent removal of said carbon turning bar from said deleaver except for servicing or the like, including a sleeve secured to said deleaver and opening into said chute, a stub shaft slidably received in said sleeve for limited axial movement therein, and a pivot connecting said stub shaft to said carbon turning bar.

4. The deleaver of claim 3 wherein said sleeve includes a longitudinal closed ended slot and further including a pin in said slot and secured to said stub shaft.

* * * * *